US007264061B2

(12) United States Patent
Dybevik et al.

(10) Patent No.: US 7,264,061 B2
(45) Date of Patent: Sep. 4, 2007

(54) WELL PACKER FOR A PIPE STRING AND A METHOD OF LEADING A LINE PAST THE WELL PACKER

(75) Inventors: Arthur Dybevik, Sandnes (NO); Terje Moen, Sandnes (NO)

(73) Assignee: Reslink AS (NO)

( * ) Notice: Subject to any disclaimer, the term of this patent is extended or adjusted under 35 U.S.C. 154(b) by 80 days.

(21) Appl. No.: 10/532,515

(22) PCT Filed: Oct. 17, 2003

(86) PCT No.: PCT/NO03/00343

§ 371 (c)(1),
(2), (4) Date: Apr. 25, 2005

(87) PCT Pub. No.: WO2004/038167

PCT Pub. Date: May 6, 2004

(65) Prior Publication Data

US 2006/0048950 A1 Mar. 9, 2006

(30) Foreign Application Priority Data

Oct. 25, 2002 (NO) ..... 20025162

(51) Int. Cl.
*E21B 33/12* (2006.01)

(52) U.S. Cl. ..... 166/385; 166/133; 166/179; 166/188; 166/191

(58) Field of Classification Search ..... 166/179, 166/133, 188, 106, 385
See application file for complete search history.

(56) References Cited

U.S. PATENT DOCUMENTS

| | | | | |
|---|---|---|---|---|
| 4,615,389 | A * | 10/1986 | Neely et al. | 166/250.01 |
| 5,810,083 | A | 9/1998 | Kilgore | |
| 6,173,788 | B1 | 1/2001 | Lembcke et al. | |
| 6,220,362 | B1 | 4/2001 | Roth et al. | |
| 6,325,144 | B1 | 12/2001 | Turley et al. | |
| 6,367,845 | B1 | 4/2002 | Otten et al. | |
| 2002/0074119 | A1 | 6/2002 | Bixenman et al. | |

* cited by examiner

*Primary Examiner*—David Bagnell
*Assistant Examiner*—Giovanna M Collins
(74) *Attorney, Agent, or Firm*—Andrus, Sceales, Starke & Sawall, LLP

(57) ABSTRACT

The invention concerns an external well packer (4, 4', 4") for a pipe string (2), and also a method of leading at least one line (18) seamlessly past at least one packer (4, 4', 4") along the pipe string (2). What is characteristic of the packer (4, 4', 4") is that it consists of a continuous inner packer ring (8) and a separate and continuous outer packer ring (10), which in the operating position encloses the inner packer ring (8) in a pressure tight manner. The fitting surface of at least one of the packer rings (8, 10) is provided with at least one through-going line slot (16, 16'), which in the operating position encloses a line (18) in a pressure tight manner. This allows continuous lines (18) to be stretched out past several such packers (4, 4', 4").

15 Claims, 11 Drawing Sheets

WELL PACKER FOR A PIPE STRING AND A METHOD OF LEADING A LINE PAST THE WELL PACKER

CROSS REFERENCE TO RELATED APPLICATION

The present application is the U.S. national stage application of International Application PCT/NO2003/000343, filed Oct. 17, 2003, which international application was published on May 6, 2004 as International Publication WO 2004/038167. The International Application claims priority of Norwegian Patent Application 20025162, filed Oct. 25, 2002.

BACKGROUND OF THE INVENTION

The present invention regards an external packer for a pipe string in a well, e.g. a completion string, a production string or an injection string. The pipe string consists of several lengths of pipe joined successively as the string is run into the well. The invention also concerns a method of leading at least one line along the pipe string and seamlessly past one or more packers of the present type.

Said line may be e.g. a hydraulic line, a fibre-optic line or another electroconductive line for transmission of actuating power or control signals to downhole well equipment. The line may also be used to transmit measurement signals from downhole measuring apparatus. Moreover, the line may be an injection line used e.g. to pump well treatment fluid into the well. The line is hereinafter simply termed a control line.

The invention is suited for use in petroleum wells, but may equally well be used in other types of wells.

Normally, at least one packer is set around and along at least one pipe string in the well. This is done among other things to separate different well zones in terms of pressure, and also to safeguard the well against outflow of well fluids or reservoir fluids. In this connection it may be necessary to lead one or more control lines of the types mentioned axially past each well packer, so that the line(s) may reach the correct location in the well. This is particularly relevant during well completion. When a control line is passed axially through and past a well packer, it is important to ensure that the guide passage(s) through the packer is/are pressure tight. By doing so, no subsequent leakage can occur between the adjacent zones separated by the packer.

According to prior art, a control line may be led past a well packer via an axial passage through the inner metal core of the well packer, the core being enclosed by an outer sealing element made from a flexible material, e.g. an elastomer. Moreover, the well packer may be provided with several axial passages for lead-through of several control-lines. The two axially opposite openings of a passage are each fitted with a coupling adapted to the type of control line in question. Thus the coupling may be a pipe coupling for a fluid-carrying pipe, or it may be a connector for an electro-conductive cable. In the latter case the two connectors of the well packer may be interconnected via a suitable line located in said packer passage. Consequently, each axial side of the packer is connected to a separate length of line.

Thus the control line consists of several successive lengths of line interconnected via said couplings in each well packer. The connections are carried out at the same time as the successive assembly of the associated pipe string takes place, all while this is being lowered into a well. Continuous connection of such lengths of line is demanding and time consuming and therefore also costly. In addition, having several connectors along the control line entails a greater risk of signal deterioration or potential pressure leaks via these. If the control line is electroconductive, several connectors could also lead to a greater risk of inflow of well fluids, which may have an adverse effect on the electrical circuit in the line.

U.S. Pat. No. 6,173,788, on the other hand, shows a well packer with a circular and flexible sealing element which is provided with at least one axial slot in which a control line of the above type may be placed in connection with the assembly of an associated pipe string. With this, a continuous control line may be stretched out past one or more such packers without having to join one or more lengths of line. This also avoids the above disadvantages associated with the use of line connectors. This reduces the installation time for the control line and reduces the risk of pressure leaks from or via the control line, and, if appropriate, will also reduce the risk of well fluid invasion into an electroconductive cable.

The line slot according to U.S. Pat. No. 6,173,788 may be formed in the external surface of the flexible sealing element and face outwards in the radial direction, thereby making it easy to place a control line in the slot. During the subsequent activation and axial compression of the sealing element, the sealing element expands outwards in the radial direction until it makes peripheral contact with an external pipe or borehole wall. On further expansion of the sealing element, the flexible material of the slot wall will in principle be pressed sealingly around the conductor. However, this will require at least one peripheral layer of the sealing element to be formed in a highly pliable and malleable material such as soft rubber, which in the operating position forms a seal around the control line. However, such material properties will reduce the rigidity and shear strength of the sealing element, weakening the ability of the well packer to resist axial compressive forces in the well. When a control line is arranged in the radially outmost surface of the well packer, thus projecting a maximum distance from the pipe string, it also has poor protection against frictional damage caused by possible contact with a enclosing pipe or a borehole during run-in into a well. Similarly, said material in the peripheral layer of the sealing element may also easily sustain damage when running into the well.

The line slot according to U.S. Pat. No. 6,173,788 may also be formed in interfaces between individually adjacent insert components in a flexible sealing element, where, when in the operating position, the components abut each other and form the circular sealing element. Seen in relation to the previous variety, this embodiment is significantly more flexible in use. As an example, the sealing element may be assembled and positioned along the pipe string at short notice, and preferably at a well location. The line slot may also be provided in an axial bore located inside of the external surface of the sealing element, with the control line then being protected against damage when running into the well. It may however be difficult upon activation and expansion of such a discontinuous sealing element, to achieve an adequate pressure seal around the control line and between the adjoining surfaces of the individual insert components.

SUMMARY OF THE INVENTION

The object of the invention is to improve and facilitate the leading of one or more control lines past at least one well packer on the outside of a pipe string in connection with the assembly and running of this into a well. The invention also aims to avoid or reduce the above disadvantages of prior art.

The object is achieved as specified in the description below and the following claims.

Using the present invention allows protected installation of at least one continuous control line along the outside of a pipe string in a well. The term continuous line should be understood as a control line preferably completely free of joints/couplings along its overall length, or optionally that the overall length of the control line comprises only a few lengths of line interconnected preferably at positions between the well packers of the pipe string. Such a continuous control line may therefore be several kilometres long.

According to the invention, the object is achieved through each external well packer along the pipe string consisting in principle of two packer rings, which in the operating position are assembled in the radial direction. Each well packer consists of a continuous outer packer ring placed outside a continuous inner packer ring. One or more control lines are disposed in separate lead-through slots, preferably an axial slot, between the two packer rings. Hereinafter, such a lead-through slot will simply be denoted an axial slot. In U.S. Pat. No. 6,173,788, only one packer ring is used to enclose a control line in the operating position, which is materially different from the present well packer.

In the present well packer, the inner packer ring may consist of a separate packer unit connected to the outside of the pipe string, or it may be integrated as a specially constructed external annular portion of the pipe string. The outer packer ring, on the other hand, must consist of a separate packer unit, which in the operating position is coupled to the outside of the inner packer ring.

Both the outer and inner packer ring may consist of several packer components which in the operating position have been assembled to act as a packer ring. Moreover, packer components in a packer ring may be assembled in the axial and/or radial direction. This will be illustrated in greater detail in the following examples of embodiments. Of these packer components, at least the pressure sealing elements of each packer ring must be continuous in order for the well packer to provide optimal sealing and functional stability in the well. The fact that the present sealing elements are individually continuous also constitutes a material difference compared with the preferred embodiment of the well packer according to U.S. Pat. No. 6,173,788, where the well packer has a sealing element consisting of at least two insert components.

Said packer components may as an example comprise metal rings for locking or supporting other packer components, supporting rings or gaskets formed in certain materials with special properties, including profiled rings, together with various fastening equipment for interconnection and attachment of the packer components. Such packer components, on the other hand, are included in prior art.

Said axial slot may be formed in only one of the packer rings, preferably in the inner packer ring. Alternatively, the axial slot can be made up of a partial axial slot in each packer ring, the two partial axial slots together forming the axial slot around the control line. In the latter example therefore, the inner packer ring is formed with an axial slot in the outer surface, while the outer packer ring is formed with an axial slot in the inner surface. In the operating position, the two axial slots co-operate to form a pressure tight seal around the control line.

Actuation of the present well packer is carried out by known methods, e.g. by means of a hydraulic actuating force or a direct mechanical actuating force on the packer. The well packer may also be set in dedicated packer bores in surrounding pipes through a force fit.

When running the pipe string into the well, the outer packer ring will protect the control line(s) against direct contact with surrounding pipes or the borehole, so as to avoid any frictional damage to the line(s). Therefore, as a result of this packer design, the outer packer ring may be made from materials that have sufficient rigidity, shear strength and wear resistance to resist said friction during the run-in into the well, but which are also strong enough to resist compressive forces in the well after the packer has been set.

The invention also comprises a method of mounting a plurality of well packers of the present type on a pipe string together with a continuous control line, with assembly taking place as the pipe string is run into the well. As the packer rings in the well packer are provided with individually continuous sealing elements, the assembly of this equipment must be carried out in a certain order.

The procedure is initiated by each packer position along the outside of the pipe string being connected to or formed with an inner packer ring of the present type. These packer rings may be pre-installed or pre-machined on individual pipes prior to the delivery of the pipe string at the well location. Alternatively, an inner packer ring may be threaded around the free end of the pipe string when running this into the well, as such packer rings may then be installed consecutively during the run-in. Several known methods may be used for mounting the packer rings, e.g. heating and/or lubrication of the packer rings.

A number of outer packer rings are then set out in a logical order for subsequent feeding to the pipe string in a sequential manner. If a packer ring comprises several annular packer components, these are also set out in a logical order for subsequent feed-out and assembly of these. The number of outer packer rings should at least correspond to the number of inner packer rings to be used on the outside of the pipe string. The outer packer rings may as an example be fed from a dispenser such as a piece of piping on which the packer rings have been arranged. Said succession of outer packer rings may optionally be followed by individually continuous and flexible spare components for these. Relative to the direction of feed-out, such spare components are preferably placed sequentially behind the succession of outer packer rings. If such a flexible packer component is damaged or destroyed during mounting to the pipe string, a similar spare component can be bent in a flexible manner and led past the succession of outer packer rings in order to replace the damaged/destroyed component on the pipe string.

The at least one control line of the pipe string is then passed through all of the outer packer rings and any spare components, and then onwards along the pipe string, where the line may terminate in a free inlet/outlet, or it may be connected to well equipment at this location. Hereinafter, reference will be made to only one control line, for the sake of simplicity. When running the pipe string into the well, the control line is fed out continuously from e.g. a cable drum.

The control line is then connected to the inner packer ring of the first and in the operating position deepest well packer of the pipe string, the line being placed in the axial slot of the packer ring.

Then the most proximal of said outer packer rings is passed along the at least one control line and on to the pipe string.

The outer packer ring is then pulled over and around the control line and the inner packer ring as a sealing sleeve. If the outer packer ring is provided with a partial axial slot along its inner surface, this axial slot is placed superjacent to the control line. With this, the first and deepest well packer of the pipe string is made ready for running into the well.

More lengths of the pipe string are then assembled and run into the well, while the control line is fed out continuously along the pipe string.

Likewise, the control line is connected to an axial slot in the next inner packer ring along the pipe string, whereupon a new outer packer ring is passed up to and connected around the control line and said next inner packer ring. With this, the second well packer of the pipe string is ready for running into the well.

By repeating the above connection procedure, the control line may be connected to any possible subsequent well packers.

Finally, the control line is connected to the relevant surface equipment in a known manner.

Mounting the control line in accordance with this method avoids or reduces the above disadvantages of prior art.

Details of the present invention will be illustrated in greater detail in the following example of an embodiment.

BRIEF DESCRIPTION OF THE DRAWINGS

The following describes a non-limiting example of an embodiment of the present invention.

DETAILED DESCRIPTION OF THE INVENTION

The appended figures are schematic and may be somewhat distorted with regard to the shape, relative dimensions and mutual positioning of the components. In the following, identical details in the figures will be indicated by the same reference number.

Figure 1:
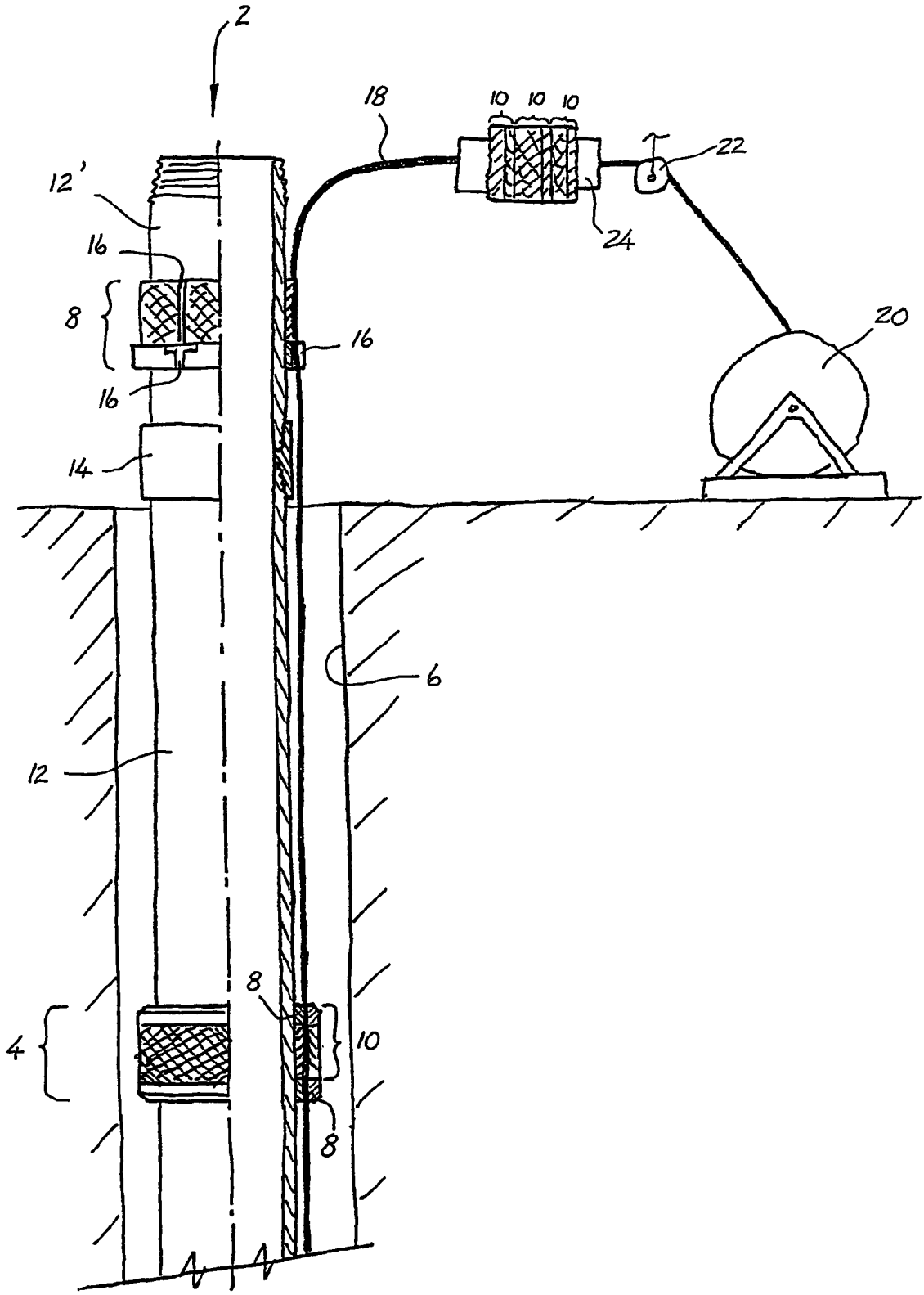
FIG. 1 depicts a partial section through a completion string and its external packers as the string is being run into a well, with a continuous control line simultaneously being mounted to the packers of the completion string by use of the method and well packer of the present invention.

FIG. 1 shows a completion string 2, the outside of which is provided with well packers 4, and which is about to be screwed together and run into a well 6. According to the invention, each well packer 4 consists of a continuous inner packer ring 8 and a continuous outer packer ring 10. In the operating position, the outer packer ring 10 is placed outside the inner packer ring 8. Each packer ring 8, 10 is fitted with at least one flexible and expandable sealing element formed from e.g. a rubber material or an elastomer.

The completion string 2 consists of individual pipes 12 that are screwed together consecutively and lowered into the well 6. In the figure, the upper, free end of the string 2 is made up of a short pipe 12' connected to a pipe 12 of ordinary length via a pipe coupling 14. The short pipe 12' is fitted with an inner packer ring 8, the outer surface of which has several axial slots 16. Advantageously the inner packer rings 8 of the completion string 2 are pre-installed on the outside of their respective short pipes 12'. With this, packer components on a pipe 12', or possibly the entire pipe 12 and its inner packer ring 8, may easily be replaced if necessary. This also facilitates the addition of any further, unplanned well packers 4 to the completion string 2.

A control line 18 is then arranged in each axial slot 16 in the inner packer ring 8. For simplicity, FIG. 1 shows only one control line 18 connected to the completion string 2. The required number of continuous control lines 18 is fed out from separate drums 20, e.g. via pulleys 22, and continuously joined with the respective axial slots 16 in the inner packer ring 8 in question. At the same time, several outer packer rings 10, initially the same number as the total number of inner packer rings 8 in the string 2, are arranged in succession on a tubular dispenser 24. FIG. 1 shows a total of three outer packer rings 10 arranged on the outside of the dispenser 24, each outer packer ring 10 consisting of two annular sealing elements, of which one pliantly malleable element and a metal support element for this, cf. FIGS. 6 and 7. All control lines 18 are fed through and out via the tubular dispenser 24 and the outer packer rings 10 arranged on the outside of this. When all control lines 18 have been joined with the axial slots 16 in the inner packer ring 8 in question, the most proximal outer packer ring 10 is pulled off the dispenser 24 and brought forward to the inner packer ring 8 in question. The outer packer ring 10 is then pulled over and around the control line 18 and the inner packer ring 8 as a sleeve, whereby the well packer 4 is ready to be run into the well 6. FIG. 1 shows such a finished well packer 4 below the inner packer ring 8. The above connection procedure is repeated for all the well packers 4 on the completion string 2.

Figure 2:
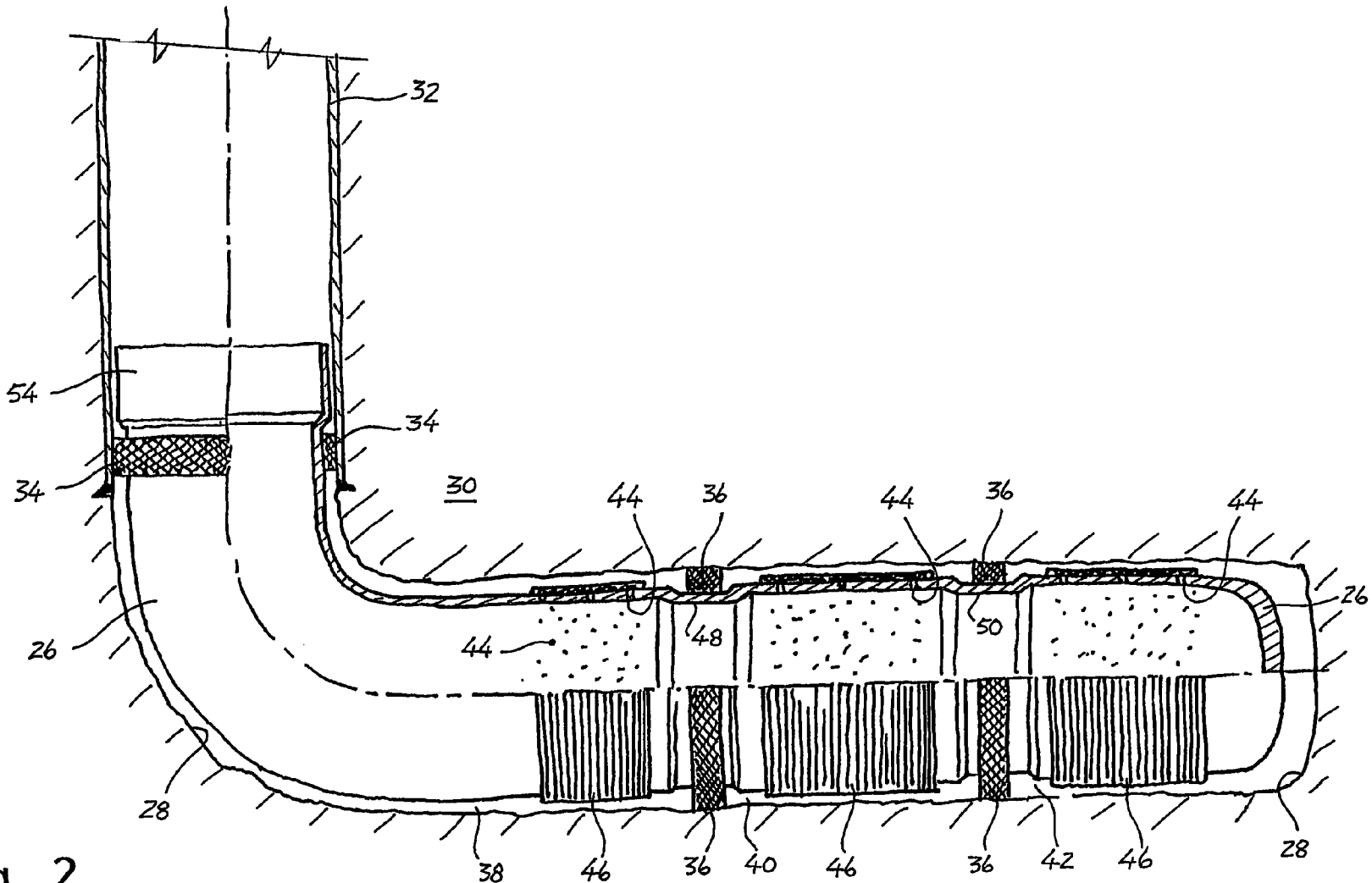
FIG. 2 depicts a partial section through the well liner prior to the completion string being placed in the liner.

FIG. 2 shows the liner 26 of the well 6 in a horizontal borehole 28 through a ground formation 30 prior to the placement of the completion string 2 in this. The upper end of the liner 26 is attached to a preceding casing 32 by means of an ordinary hanger packer 34. In addition, the liner 26 is provided with two external packers 36 set in the borehole, and which divide the borehole 28 into three separate pressure zones 38, 40, 42. Along each pressure zone 38, 40, 42 the liner 26 is provided with perforations 44 and an external sand screen 46. In addition, two internal setting sections 48, 50 of the liner 26 are formed with a narrower bore than the rest of the liner 26. In order to be able to insert and set the well packer 4 in the liner 26 by use of a force fit, the deepest setting section 50 is preferably constructed with a smaller diameter than that of the previous setting section 48. Thus, in the case of a force fit, the setting sections of a liner may be formed with successively decreasing diameters in the downward direction.

Figure 3:
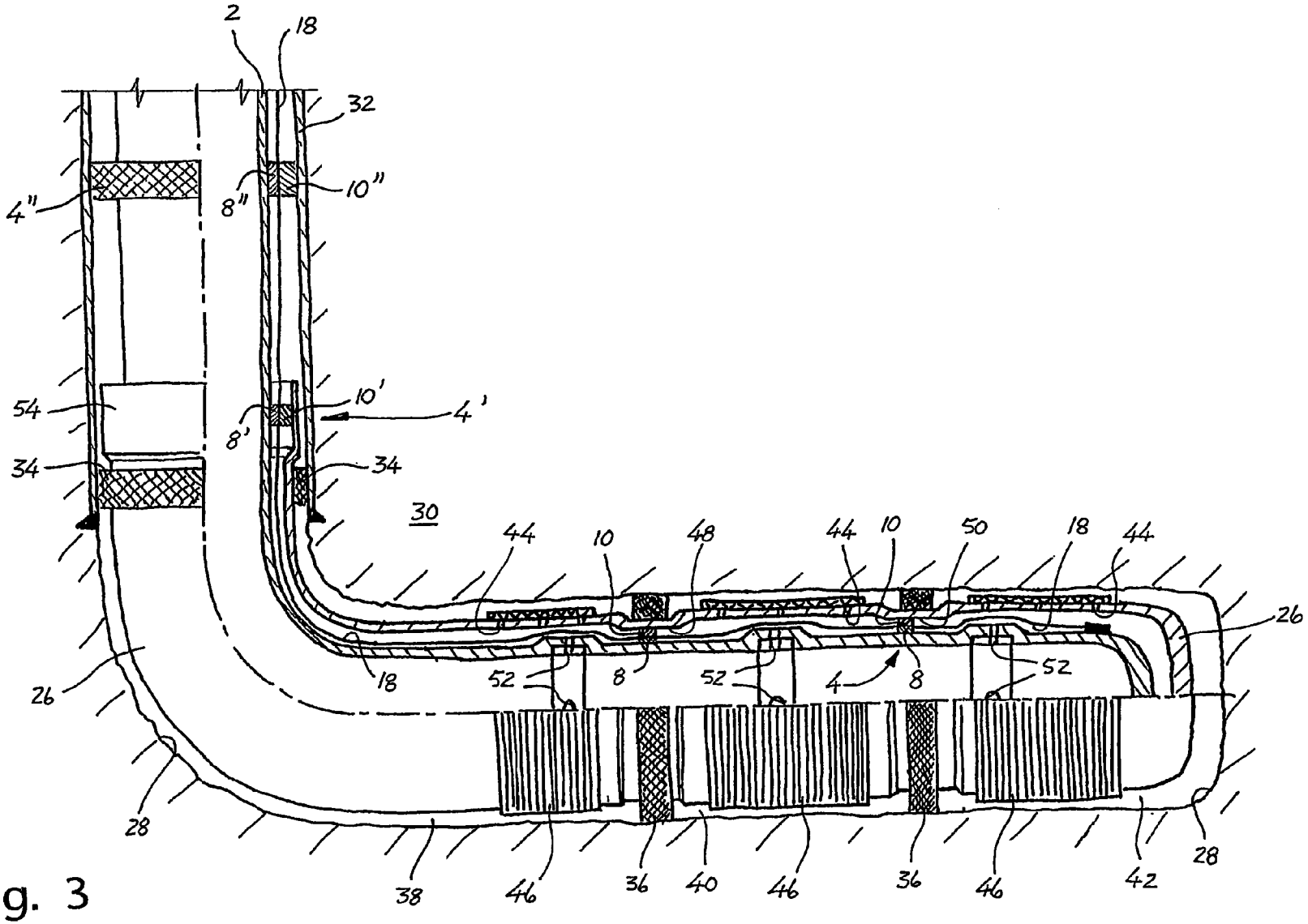
FIG. 3 depicts a partial section through the well liner after the completion string and its continuous control line have been set in the liner by use of a force fit between its well packers and the liner.

FIG. 3 shows the completion string 2 after this has been set in the liner 26. In the horizontal section of the borehole 28 the completion string 2 is shown as being provided with two well packers 4 fixed to separate setting sections 48, 50 through the use of a force fit. With this, the control line 18 is placed sealingly between the inner and outer packer rings 8, 10 of each well packer 4. The completion string 2 is provided with bores 52 above each pressure zone 38, 40, 42 of the borehole 28, through which fluids may flow into or out of the string 2. In FIG. 3, the completion string 2 is also shown as being provided with further well packers 4', 4" of the present type, but with larger external diameters than said packers 4 in the liner 26. The packers 4', 4" also consist of separate inner packer rings 8' and 8", respectively, and outer packer rings 10', 10", respectively, which in the operating position enclose the control line 18 in a pressure tight manner. Through use of a force fit, the well packer 4' is set in an expanded and honed bore 54 inside the upper end of the liner 26. Well packer 4", on the other hand, is shown as being placed in an expanded position against said casing 32, the packer 4" being actuated by an axial actuating force through known methods.

FIGS. 4-7 show a non-limiting example of a well packer 4 according to the invention, the figures illustrating the installation of consecutive packer components around a control line 18 in the well packer 4. Only a peripheral section of the packer components of the well packer 4 has been shown.

Figure 4:
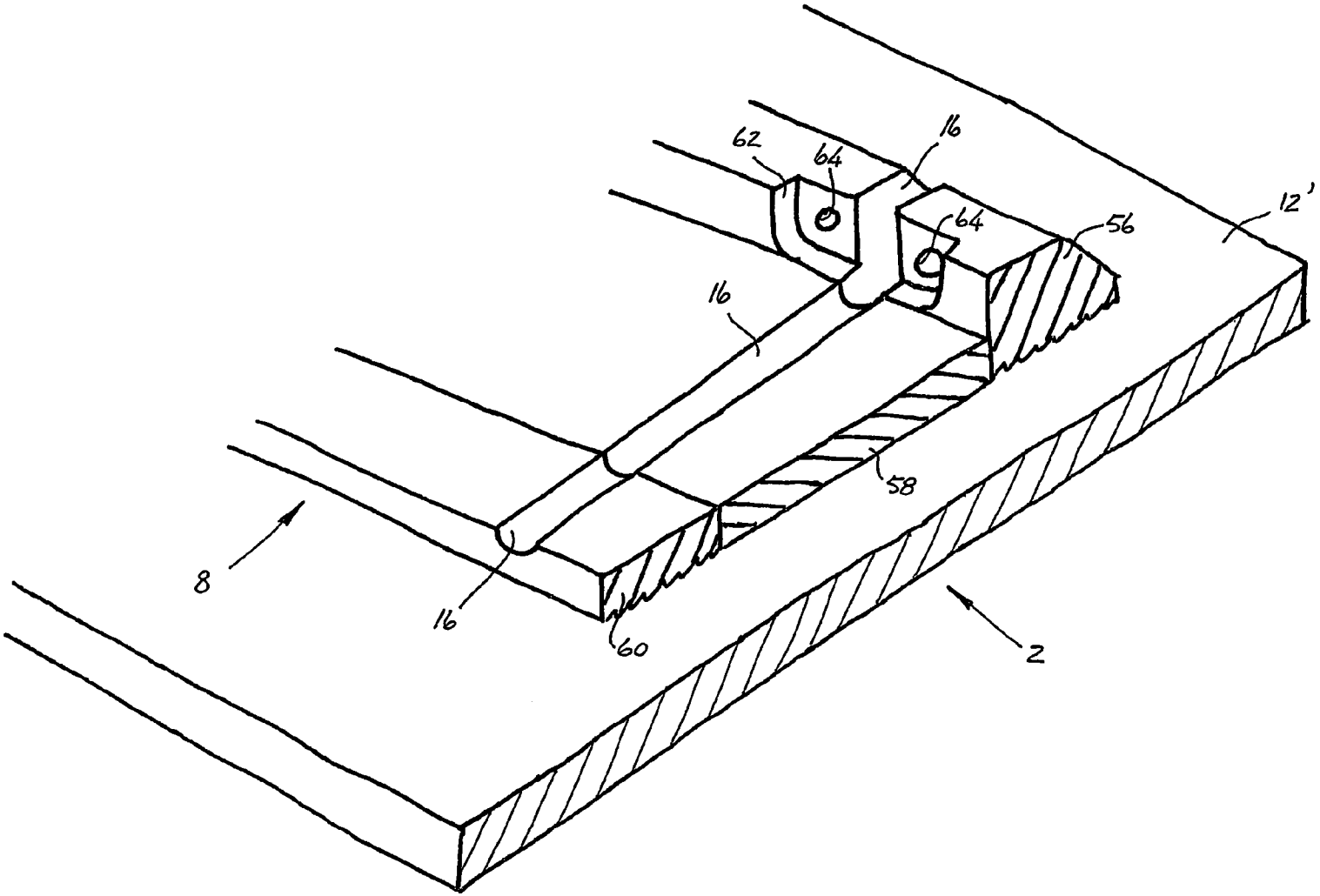
FIGS. 4-7 illustrate the mounting of successive packer components around a control line in a well packer consisting of a separate outer packer ring and a separate inner packer ring, the figures showing cut-out details of the well packer and its control line during these steps; and where

FIG. 4 shows an inner packer ring 8 coupled to a short pipe 12' in a completion string 2. The packer ring 8 is constructed from, successively, a lower and radially projecting metal ring 56, a rubber ring 58 and an upper metal ring 60. In the operating position the lower metal ring 56 constitutes the lowermost component of the packer ring 8. The packer components 56, 58, 60 are formed with separate axial recesses that, when placed together, form the axial slot 16. In addition, the lower metal ring 56 has a slot 62 for a fixing plate at right angles to the axial slot, which fixing plate slot is formed with axial threaded bores 64.

Figure 5:
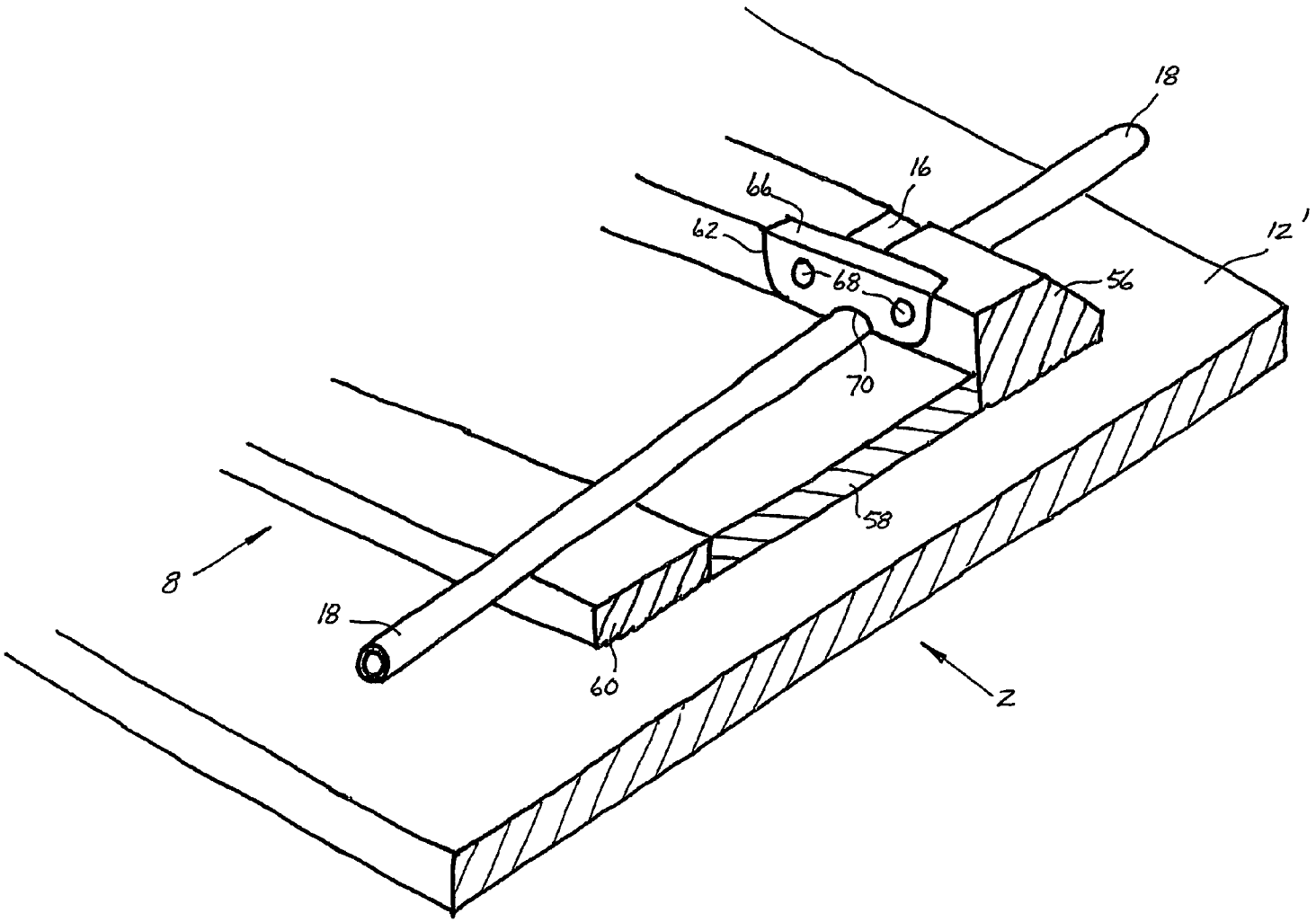

FIG. 5 shows the control line 18 arranged in the axial slot 16 and secured against this by means of a fixing plate 66. The plate 66 is placed in the fixing plate slot 62 of the metal ring 56 and fastened to this by countersunk fixing bolts 68. An inner fitting face 70 of the fixing plate 66 is shaped so as to be complementary to the control line 18 and encloses this.

Figure 6:
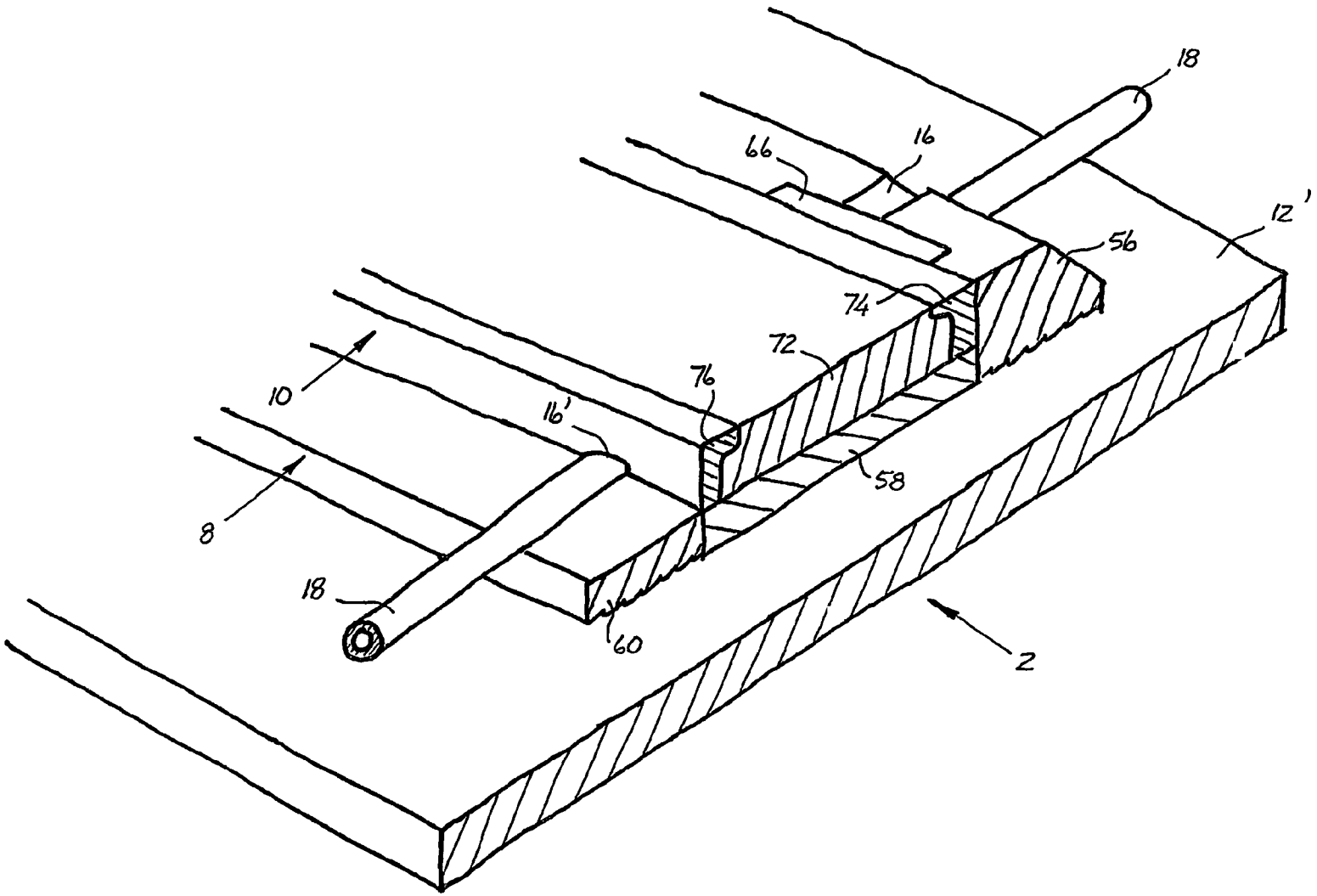

FIG. 6 shows flexible components of an outer packer ring 10 of the well packer 4. The components are removed successively from the tubular dispenser 24 and passed on to the inner packer ring 8, then to be mounted sequentially on the outside of the inner packer ring 8. The flexible components consist of a central rubber ring 72, the axial sides of which are each provided with a support ring 74, 76 having an L-shaped cross section, and which are formed from a more rigid material than that of the rubber ring 72. The rubber ring 72 and its support rings 74, 76 together form the above mentioned flexibly malleable element, cf. discussion of FIG. 1. The support rings 74, 76 and the rubber ring 72 are each formed with an axial recess along the inner surfaces.

Figure 7:
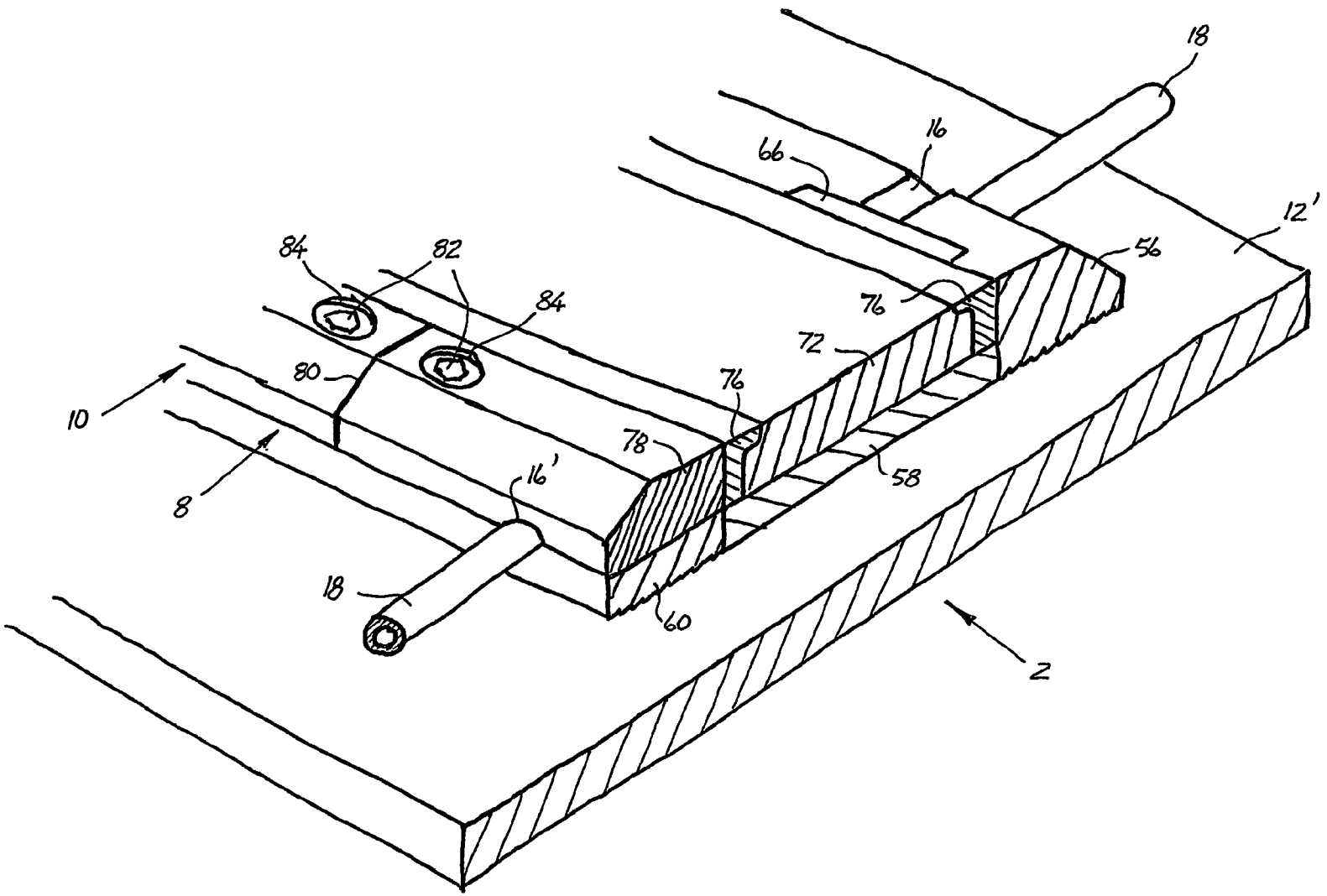

FIG. 7 shows the last step of the installation of the outer packer ring 10 on the outside of the inner packer ring 8. In this step, an upper metal ring 78 is removed from the dispenser 24 and mounted on the outside of the upper metal ring 60 of the inner packer ring 8. The metal ring 78 has a radial through slit 80 to make it easier to thread the ring around the metal ring 60 of the inner packer ring 8. On either side of the slit 80, the metal ring 78 is fixed to the underlying metal ring 60 by means of countersunk fixing bolts 82 placed in radial bores 84. The overhead metal ring 78 is also formed with an axial recess along its inner surface, which recess forms an axial slot 16' when placed together with the recesses of the rubber ring 72 and its support rings 74, 76. In the operating position the axial Blots 16, 16' together form a pressure tight seal around the control line 18. With this, the well packer 4 is ready for running into a well 6.

Figure 8:
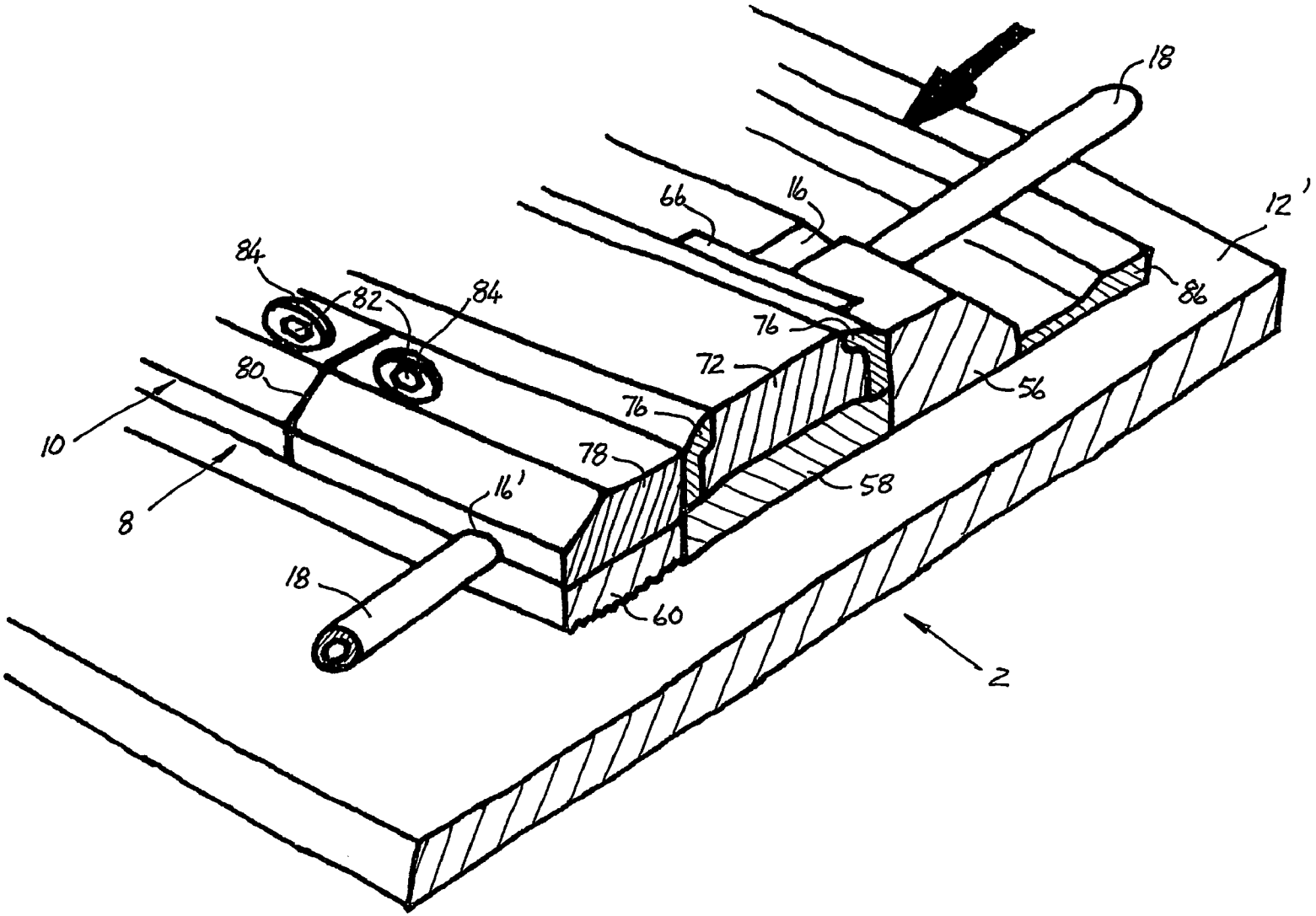
FIG. 8 shows cut-out details of a well packer according to FIGS. 4-7, wherein the well packer is shown as being expanded in the radial direction by an axial actuating force indicated by an arrow in the figure.

FIG. 8 shows a well packer 4 according to FIGS. 4-7, but here the packer 4 is also provided with a connecting sleeve 86 placed around the pipe 12' and below the metal ring 56 of the inner packer ring 8. An axial actuating force, illustrated with an arrow in the figure, exerts a mechanical pushing force on the connecting sleeve 86 and the metal ring 56. The rubber rings 58, 72 and the support rings 74, 76 are thereby compressed axially and expanded outwards in the radial direction against an anchoring object (not shown) such as a borehole 28, a liner 26 or a casing 32. At the same time, the axial slots 16, 16' in the rubber rings 58, 72 are pressed radially against the control line 18, forming a pressure tight seal around this. For instance, the well packer 4" of FIG. 3 is actuated in this way.

Figure 9:
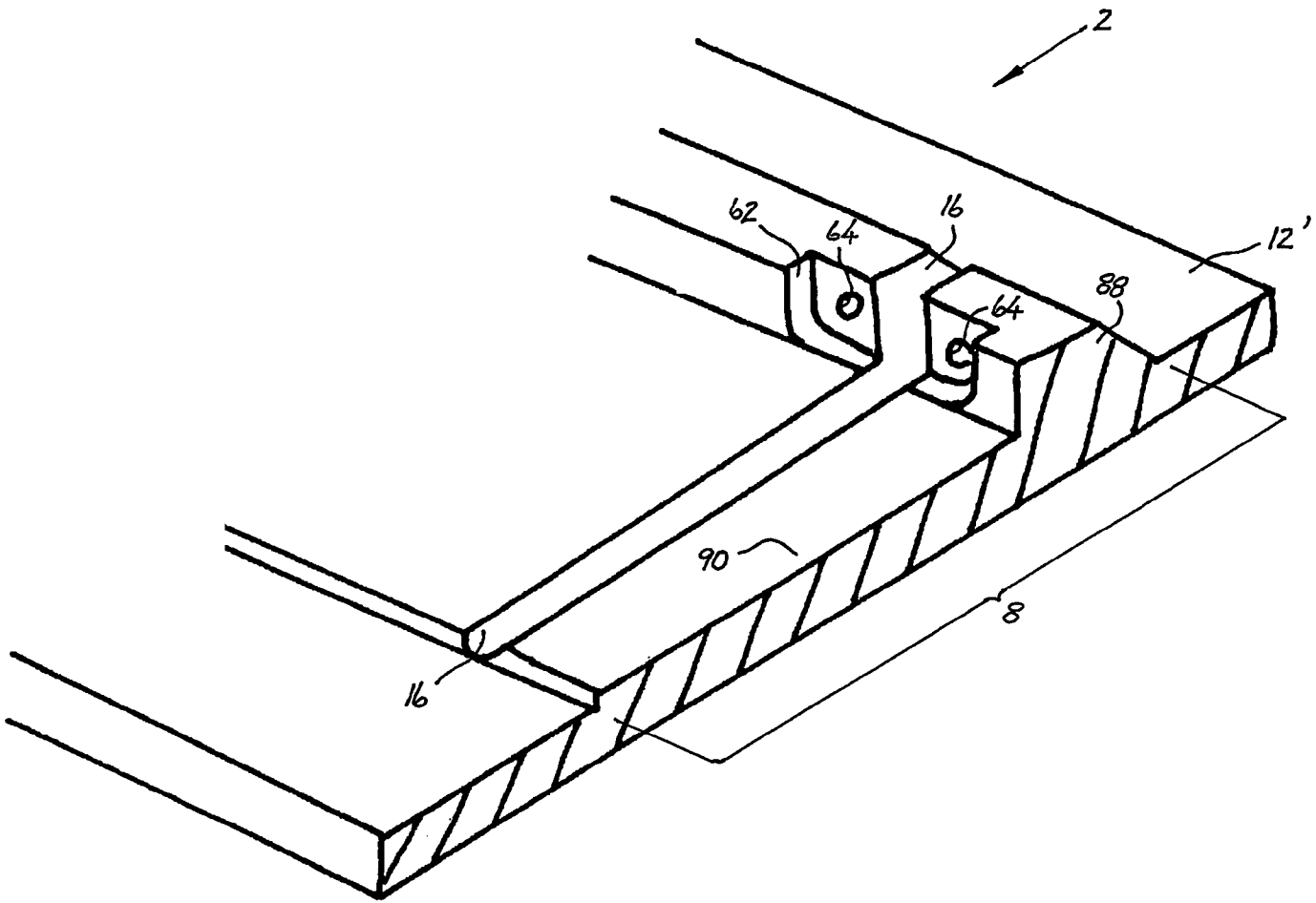
FIGS. 9-11 also illustrate the mounting of successive packer components around a control line in a well packer consisting of a separate outer packer ring and an inner packer ring pre-machined onto the surface of a pipe in a completion string.
Figure 10:
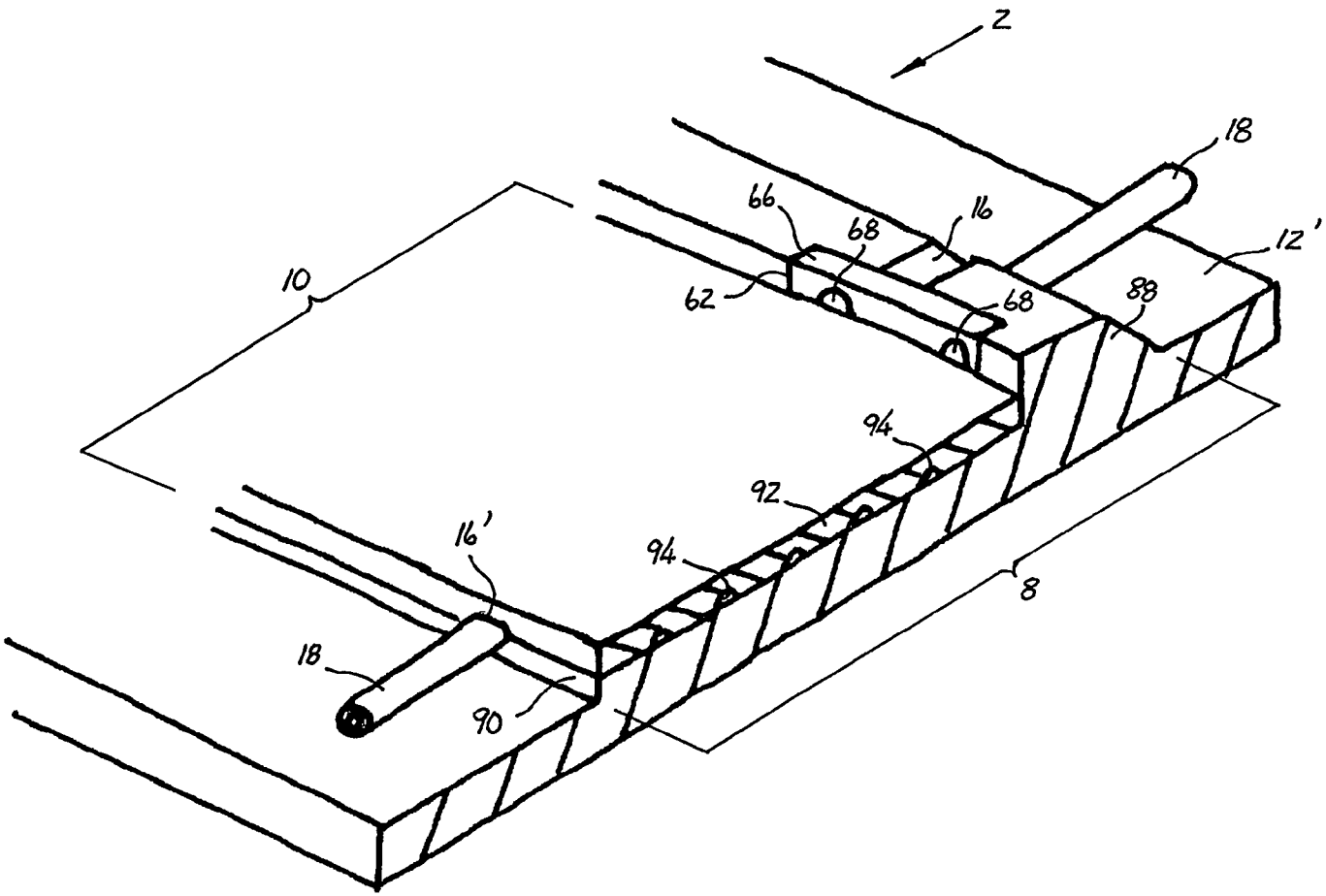
Figure 11:
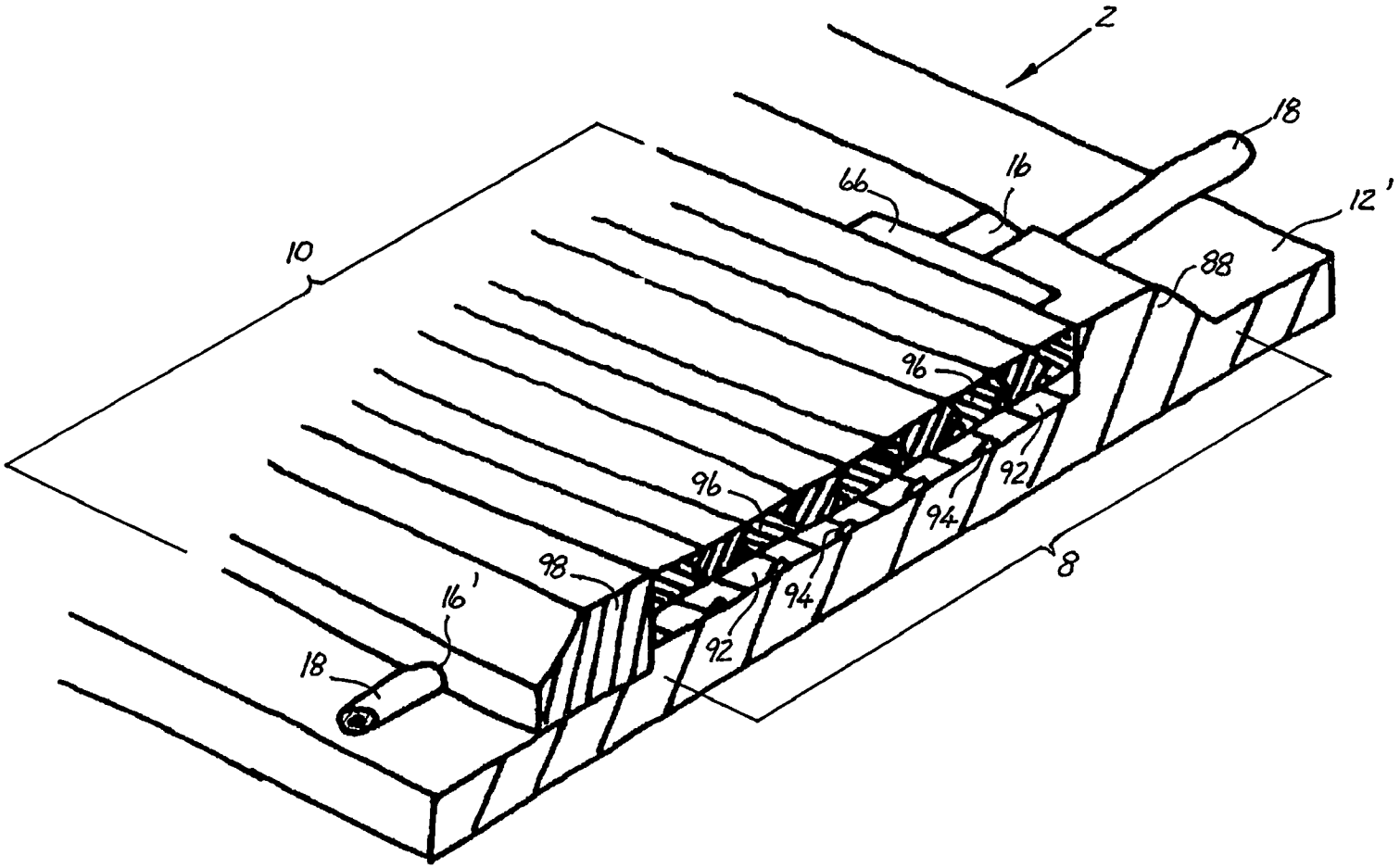

FIGS. 9-11 show another non-limiting example of a well packer 4 according to the invention. These figures also illustrate the mounting of successive packer components around a control line 18 in the well packer 4, with only a peripheral section of the packer components being shown.

FIG. 9 shows an inner packer ring 8 that constitutes a machined and integral part of the surface of a short pipe 12' in a completion string 2. Like the separate inner packer ring 8 of FIG. 4, the machined packer ring 8 also has a projection in the form of a lower and radially projecting metal ring 88. The machined packer ring 8 also has an upper metal ring 90 that is wider and slightly less prominent than the lower metal ring 88, the metal rings 88, 90 thus being graduated down towards the pipe 12'. The upper metal ring 90 corresponds to the rubber ring 58 and the upper metal ring 60 of FIG. 4. The metal rings 88, 90 are also formed with axial recesses that form said axial slot 16. Like the lower metal ring 56 of FIG. 4, the lower metal ring 88 of FIG. 9 is also provided with a slot for a fixing plate 62, in which are formed axial threaded bores 64.

FIG. 10 shows the control line 18 arranged in the axial slot 16 and secured against this by means of a fixing plate 66 placed in the fixing plate slot 62 of the metal ring 88 and fastened to this by countersunk fixing bolts 68. This fixing plate 66 is also formed with an inner fitting surface 70 (not shown) that encloses the control line 18 in a complementary manner. A metal sleeve or shell 92 is mounted outside the upper metal ring 90, forming part of the outer packer ring 10 of the well packer 4. The shell 92 is removed from the dispenser 24 in an ongoing operation, passed on to the inner packer ring 8 and mounted on the outside of the metal ring 90. The shell 92 is designed with a smooth exterior surface, while its interior surface is provided with an axial slot 16' that is placed over the control line 18 during installation. In this embodiment, the interior surface of the shell 92 has circular recesses 94 that are filled with a sealing compound during the installation, which compound forms a pressure tight seal against the upper metal ring 90. The sealing compound may be e.g. a soldering agent or a hardening glue/epoxy. The recesses 94 in the shell 92 may also consist of thread-shaped or axial slots.

FIG. 11 shows an axial assembly of continuous and annular V-packers 96 of a known type arranged on the outside of the metal shell 92 and secured in the axial direction by an upper metal ring 98, the V-packers 96 having a smooth exterior surface. In this embodiment, said surface is cylindrical, but the surface may also be conical. Other types of seals may also be mounted on this surface instead of the V-packers 96. Such packers 96 may be formed from rubber, plastic and/or metallic materials. The metal ring 98 may be continuous or exhibit one or more slits 80, cf. FIG.

7. Moreover, the ring 98 is formed with an internal axial recess that forms a part of the axial slot 16', and which encloses the control line 18. The annular V-packers 96 and the upper metal ring 98 also form part of the outer packer ring 10 of the well packer 4. These components may be arranged sequentially on the outside of said dispenser 24 and be fed out in a logical order, in order then to be threaded over and around the metal shell 92. Alternatively, the V-packers 96 may be pre-fitted on the outside of the metal shell 92, so that an assembly of these is fed from the dispenser 24 and mounted on the metal shell 92. A particular benefit of this packer design is that the seal around the control line 18 may be quality checked and possibly pressure tested before the ready installed well packer 4 is run into the well 6. A well packer 4 assembled in this manner is well suited for force fit setting in well tubing, e.g. the honed bore 54 at the upper end of the liner 26, cf. FIG. 3.

The invention claimed is:

1. An external packer for a pipe string in a well, the packer being arranged for allowing at least one line to be led seamlessly past the packer, the packer comprising:

a continuous inner packer ring and a separate and continuous outer packer ring, wherein the outer packer ring is adapted to enclose an outside of the inner packer ring in a pressure tight manner when in an operating position, and wherein a fitting surface of at least one of the packer rings is provided with at least one axially directed and through-going slot adapted to receive the line in a pressure tight manner when in the operating position.

2. The packer according to claim 1, wherein the inner packer ring is a separate packer unit.

3. The packer according to claim 2, wherein the inner packer ring comprises several annular packer components which, when in their operating positions, are fitted together so as to function as the inner packer ring.

4. The packer according to claim 1, wherein the inner packer ring is integrated as an external ring portion of a pipe in the pipe string.

5. The packer according to claim 1, wherein the outer packer ring comprises several annular packer components which, when in their operating positions, are fitted together so as to function as the outer packer ring.

6. The packer according to claim 5, wherein the packer components are assembled in an axial direction.

7. The packer according to claim 5, wherein the packer components are assembled in a radial direction.

8. A method of leading at least one continuous line seamlessly past at least one external packer placed along a pipe string in a well, wherein said at least one line is led to a well position, in which the line is either terminated freely or is connected to well equipment, the method comprising the following sequential steps:

(a) connecting each packer position along the pipe string to an inner packer ring or, alternatively, constructing each packer position along the pipe string with an inner packer ring;

(b) arranging a number of outer packer rings in logical order for subsequent and sequential feeding out to the pipe string;

(c) passing the at least one line through all of the outer packer rings and further along the pipe string;

(d) connecting the at least one line to the inner packer ring of a first packer along the pipe string, said first packer forming the deepest packer when in its operating position in the well;

(e) passing the most proximate of said outer packer rings mentioned in step (b), along the at least one line and onwards to the pipe string;

(f) pulling the outer packer ring over and around the at least one line and the inner packer ring, whereby the outer packer ring functions as a sealing sleeve around the line and the inner packer ring, and wherein each line is placed in an axial, through-going slot between respective fitting surfaces of the inner packer ring and the outer packer ring;

(g) assembling and running additional pipe lengths of the pipe string into the well while feeding out the at least one line continuously along the pipe string; and (h) repeating steps (d)-(g) for connecting the at least one line to several successive packers along the pipe string.

9. The method according to claim 8, wherein the method further comprises:

pre-installing or pre-machining the inner packer rings on individual pipes in the pipe string.

10. The method according to claim 8, wherein the method further comprises:

delivering the outer packer rings from a dispenser and passing the at least one line through the outer packer rings and the dispenser.

11. The method according to claim 10, wherein the outer packer ring comprises several annular packer components, and further comprising the step of arranging the packer components in logical order for subsequent delivery and assembly thereof.

12. The method according to claim 11, wherein the method further comprises:

feeding individually continuous and flexible spare components after the outer packer rings.

13. The method according to claim 8, wherein the outer packer ring comprises several annular packer components, and further comprising the step of arranging the packer components in logical order for subsequent delivery and assembly thereof.

14. The method according to claim 13, wherein the method further comprises:

feeding individually continuous and flexible spare components after the outer packer rings.

15. An external packer for a pipe string in a well, the packer adapted to allow at least one line to be led seamlessly past the packer, the packer comprising:

a continuous inner packer ring having an inner sealing surface for sealingly enclosing an outside surface of the pipe string in a pressure tight manner;

a separate and continuous outer packer sealing ring having an inner sealing surface for sealingly enclosing an outside of the inner packer ring in a pressure tight manner; and a fitting surface provided on at least one of the inner and outer packer rings, the fitting surface comprising at least one axially directed and through-going slot adapted to receive the line in a sealed, pressure tight manner when in the operating position.

* * * * *